US005257072A

United States Patent [19]

Maeda

[11] Patent Number: 5,257,072

[45] Date of Patent: Oct. 26, 1993

[54] DISCHARGING DEVICE FOR COPYING APPARATUS

[75] Inventor: Shigeo Maeda, Hino, Japan

[73] Assignee: Konica Corporation, Tokyo, Japan

[21] Appl. No.: 863,430

[22] Filed: Apr. 3, 1992

[30] Foreign Application Priority Data

Apr. 8, 1991 [JP] Japan ..... 3-075121

[51] Int. Cl.[5] ..... G03G 21/00

[52] U.S. Cl. ..... 355/218; 346/108; 355/203

[58] Field of Search ..... 355/219, 218, 202, 203, 355/209, 220, 208, 230–231, 228, 233; 346/107 R, 108; 358/298

[56] References Cited

U.S. PATENT DOCUMENTS

| | | | |
|---|---|---|---|
| 4,634,260 | 1/1987 | Watanabe | 355/218 |
| 4,689,694 | 8/1987 | Yoshida | 358/298 |
| 4,978,996 | 12/1990 | Akamatsu | 355/231 |
| 5,021,832 | 6/1991 | Fukushima | 355/218 |
| 5,124,726 | 6/1992 | Morton et al. | 346/107 R |

FOREIGN PATENT DOCUMENTS

| | | | |
|---|---|---|---|
| 0038487 | 2/1987 | Japan | 355/218 |
| 0086378 | 4/1987 | Japan | 355/218 |
| 0086379 | 4/1987 | Japan | 355/218 |

*Primary Examiner*—A. T. Grimley
*Assistant Examiner*—Thu A. Dang
*Attorney, Agent, or Firm*—Frishauf, Holtz, Goodman & Woodward

[57] ABSTRACT

A neutralizer for use in an image forming apparatus for eliminating an electric charge from a non-image area in a surface of an image carrying member has an array of light emitting elements, a shift register and a driving device. The light emitting elements, driven by the driving device, eliminate the electric charge from a selective portion along a line across the width of the image carrying member by selectively emitting a light beam from each light emitting element. The shift register shifts-in a binary data during a registering time period, and holds the binary data during a holding time period. The driving device drives each light emitting element based on a binary data being in the register both during the registering time period and the holding time period. The light emitting elements, therefore, change their states between turn-on and turn-off states successively in the registering time period, and the neutralizer decreases the number of simultaneous changes of the the state of the light emitting elements.

3 Claims, 8 Drawing Sheets

DISCHARGING DEVICE FOR COPYING APPARATUS

BACKGROUND OF THE INVENTION

In an electrophotographic copying apparatus, a rotatable photoreceptor drum is generally used as an electrostatic image carrier, and the circumferential surface of the drum is uniformly charged before exposure. In the case where the region of an exposed image corresponding to a document image is smaller than the charged region of the circumferential surface of the photoreceptor drum, or when there is a stain on the document cover, or if copying is conducted with an open document cover, a charge remains on a non-image portion around the document image, toner adheres to the remaining charge, and thereby a stain occurs on a copied paper. Therefore, in a recent conventional copying apparatus, a discharging device is provided around the photoreceptor drum, and charge on the unnecessary portion is discharged before an electrostatic latent image is developed so that toner can not adhere to the unnecessary portion. A light emitting diode array (LED array) is used for the discharging device.

The LED array is set in a housing, and mounted on a substrate having a driving circuit and a printed circuit thereon, and arranged so that the longitudinal direction of the LED array coincides with the direction of the shaft of the photoreceptor drum. As shown in FIG. 8, the LED array is arranged so that the longitudinal direction of the LED array (a discharging device) 2 is in parallel with the direction of the shaft of a photoreceptor drum 1 between a charger 3 placed around the circumferential surface of the photoreceptor drum 1, and an image exposure portion 4. In an image process of the electrophotographic copying apparatus, the photoreceptor drum 1 is rotated clockwise as shown in the drawings, and the charger 3 charges uniformly the circumferential surface of the photoreceptor drum at a predetermined electric potential. Next, a discharger 2 located downstream turns on the LED (a light emitting diode) corresponding to the unnecessary portion of the LED array which is found in accordance with the size of a document to be copied, by CPU control. The above-described operation is conducted in synchronization with the movement of the circumferential surface of the photoreceptor drum 1, and black frame erasing is performed by discharging the unnecessary portion in accordance with the size of the document are performed, so that a latent image of the necessary portion can be formed. Then, the latent image is visualized into a toner image by a developing unit 5. The toner image is transferred onto a transfer sheet by a transfer unit 6, separated from the photoreceptor drum 1 by a separator unit 7, and a copy is obtained. Residual toner is cleaned by a cleaning unit 8, preparing for the next copying cycle. As described above, the LED array is used for discharging and black frame erasing.

Since a document, regardless of its size, is always projected symmetrically to a central line of the photoreceptor drum 1, the discharging operation for black frame erasing is performed on both sides of the photoreceptor drum by the same dimension. An LED driving circuit is based on the circuit in which an LED Li, and a current limitation resistor Ri are connected in series with a power source (for example, D.C 8 volts) and grounded. In practice, there is also a system in which a pair of two LEDs having similar light emitting characteristics, which are connected in series, are driven by a current limitation resistor Ri. In any system, turning-on or turning-off of the LED array is performed by an exclusive driving IC. After a data for turning-on or turning-off is written in a latch memory in the driving IC, and when a driving signal is inputted into the memory, the whole necessary portions of the LED array are turned on at one time. On the other hand, when a signal for turning-off is inputted, the whole LEDs, which are turned on, are turned off at one time. In this driving method, when the LED is turned on, a transient current (a dash-current) is given at one time, an electrolytic capacitor for the power source can not absorb power source variation, and driving voltage of the LED rises up from 8 volts to about 10 volts, resulting in a harmful influence on LED life. Furthermore, when the LEDs are turned off at one time, the driving voltage does not reach the ground level at once, so that residual voltage of $\pm 1$ to $\pm 2$ volts remains, and therefore, some LEDs of the LED array which are turned on remain, resulting in a stripe being generated on an image, which are problems. Related to this, since a spike-noise is generated in a driving wave-form of the driving IC during the period from turning-on of the LED to turning-off, and noises and a false operation are generated in each portion in a copying apparatus, a stain may be generated on the copied image and image quality may be lowered.

SUMMARY OF THE INVENTION

The discharging device of the present invention has been proposed in order to solve the above-described problems. The discharging device of the present invention comprises a discharging device which is disposed to face a circumferential surface of an image carrier which carries an electrostatic image. A plurality of light emitting diodes are arranged in an array to be turned on, by which charge of the above-described image carrier is discharged, and which is characterized in that a driving system of the light emitting diodes is structured so that the light emitting diodes are turned on successively or turned off successively.

DETAILED DESCRIPTION OF THE PREFERRED EMBODIMENT

Referring to the attached drawings, an example of the present invention will be described hereinafter.

Figure 1:
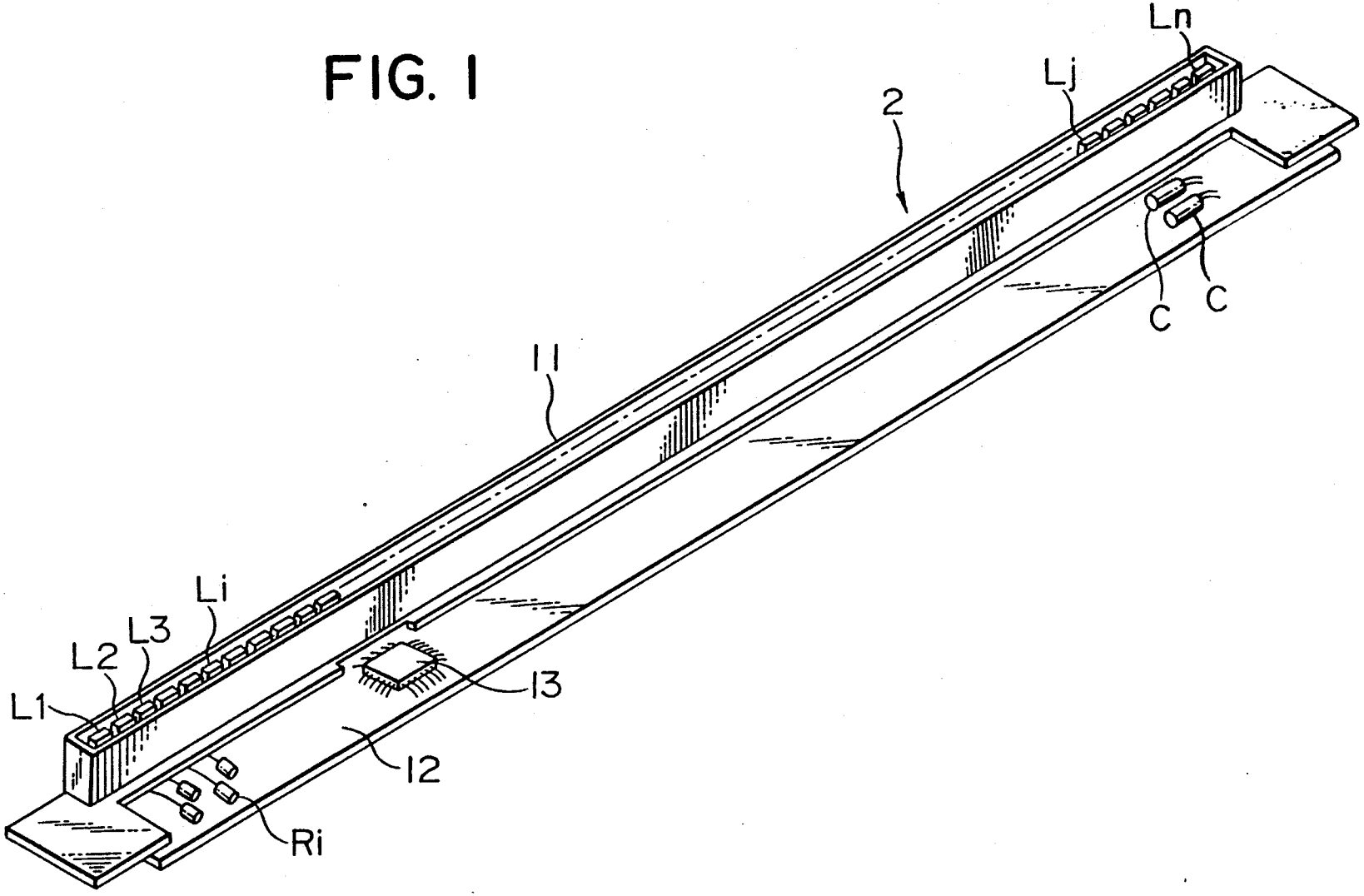
FIG. 1 is a perspective view showing a structure of a discharging device composed of an LED array of the present invention.

FIG. 1 is a perspective view showing a discharging device composed of an LED array of the present invention. The discharging device, which is used for an electrophotographic copying apparatus, is arranged array-like with a separation plate 10 sandwiched by LEDs L1, L2, L3, Li, . . . Ln (for example, n=52), and the LEDs are housed in a lamp housing 11. Further, the lamp housing and a printed circuit board 12 on which current limiting resistors for the LED, such as R1, R2, . . . Ri, . . . Rn, an IC13 for driving the LED, and capacitors C for a power source, are mounted, are integrated into one unit.

Figure 2:
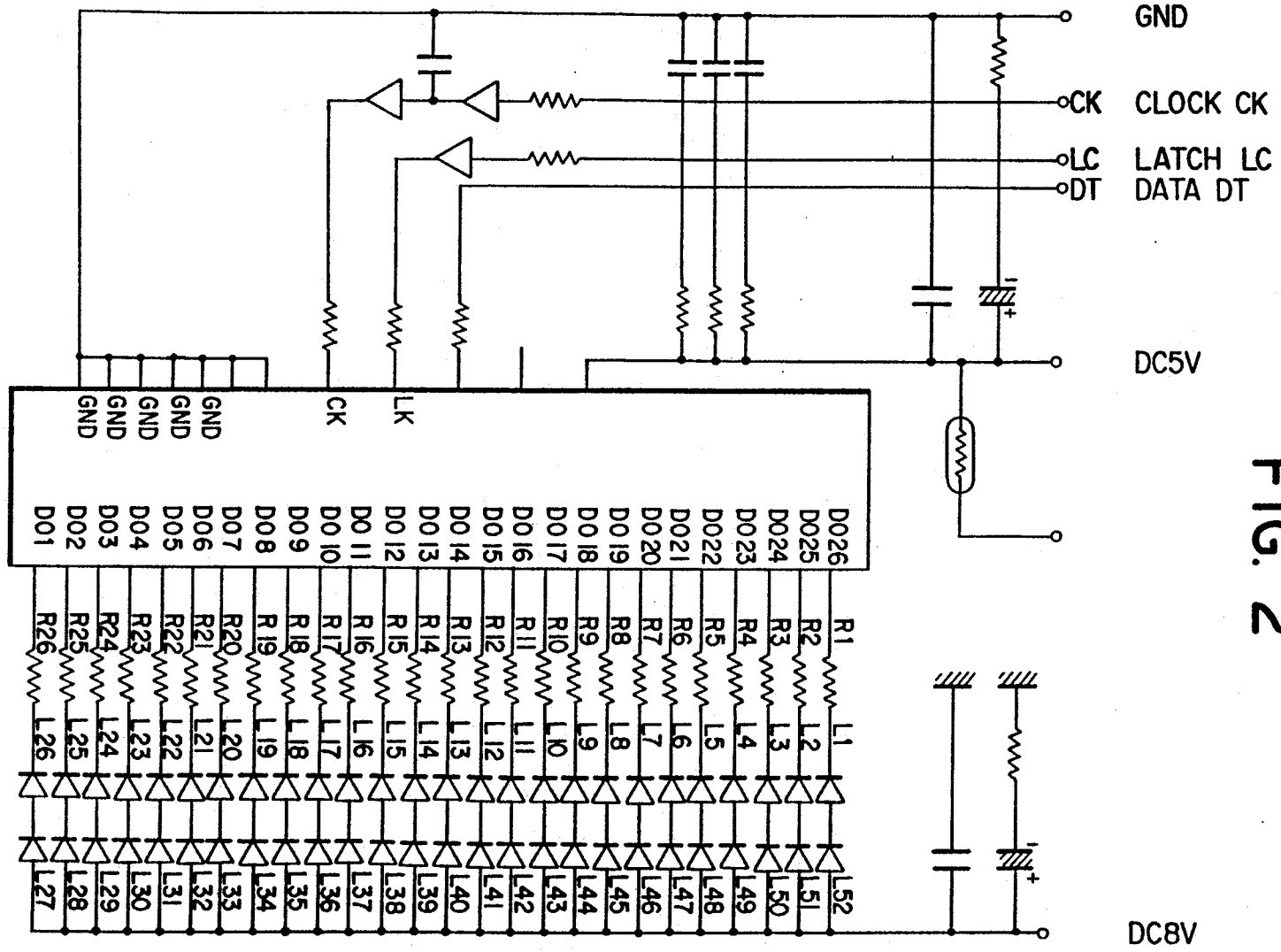
FIG. 2 is a drawing showing an IC for LED driving of the present invention, and its peripheral circuit.
Figure 3:
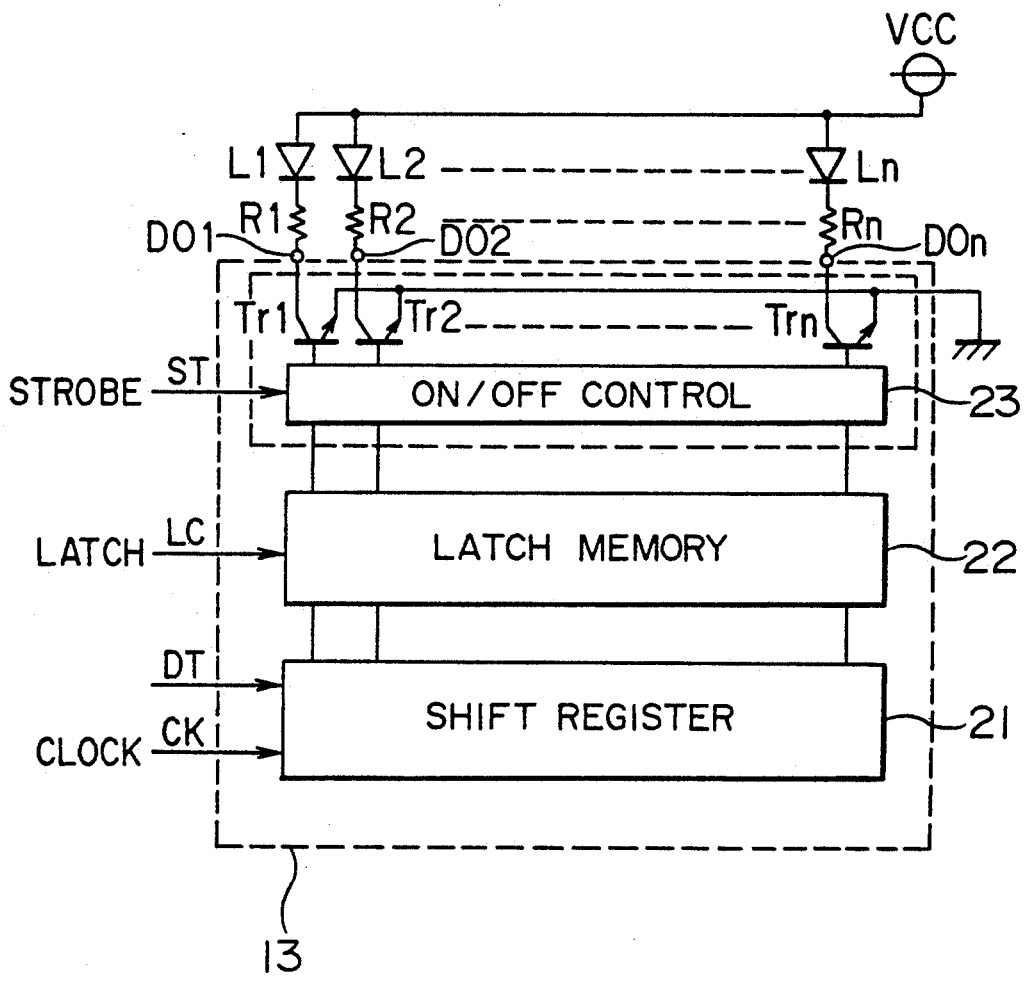
FIG. 3 is a circuit diagram showing a structure of the IC for driving and an example of its wiring.

As described above, the LED array is turned on by the IC13 for driving shown in FIG. 2 and FIG. 3. The IC13 is composed of a shift register 21, a latch memory 22, a drive (ON/OFF) control circuit 23, and transistors for driving Tr1, Tr2, .Tri . . . Trn corresponding to LEDs L1, L2, .Li . . . Ln. The number of output terminals DOi are the same as those of the LED Li, which is n, and from the output terminals DOl to DOn, the current limiting resistors R1 to Rn are connected with LED L1 to LED Ln in series, and basically, LED L1 to Ln are driven to be turned on by the above-described structure. However, as shown in FIG. 2, basically two LEDs are connected in series and driven as a pair. Due to the aforementioned manner, the number of the current limiting resistors Ri or the number of the driving system (output terminals DOi) of the IC13 for driving becomes half the number of LEDs. In order to simplify, the explanation will be made on the driving system which does not have a paired LED, by referring to FIG. 3. The IC13 for driving is provided with the latch memory 22 corresponding to LED Li. Which portion of the LEDs is turned on or turned off is determined by the method in which the turning-on or turning-off data is previously stored in the latch memory. Accordingly, input into main input terminals of the IC13 for driving are an input DT of the turning-on (or turning-off) data, driving pulse input LC for memorizing the signal in the latch memory through a shift register 21 by which serial turning-on data is converted into a parallel signal, strobe signal ST into a driving control circuit by which the LED array is turned on according to the turning-on data of the latch memory 22, and clock input CK for synchronous control. It should be noted that IC13 has a power terminal(VCC terminal) and a ground terminal (GND terminal).

Figure 4:
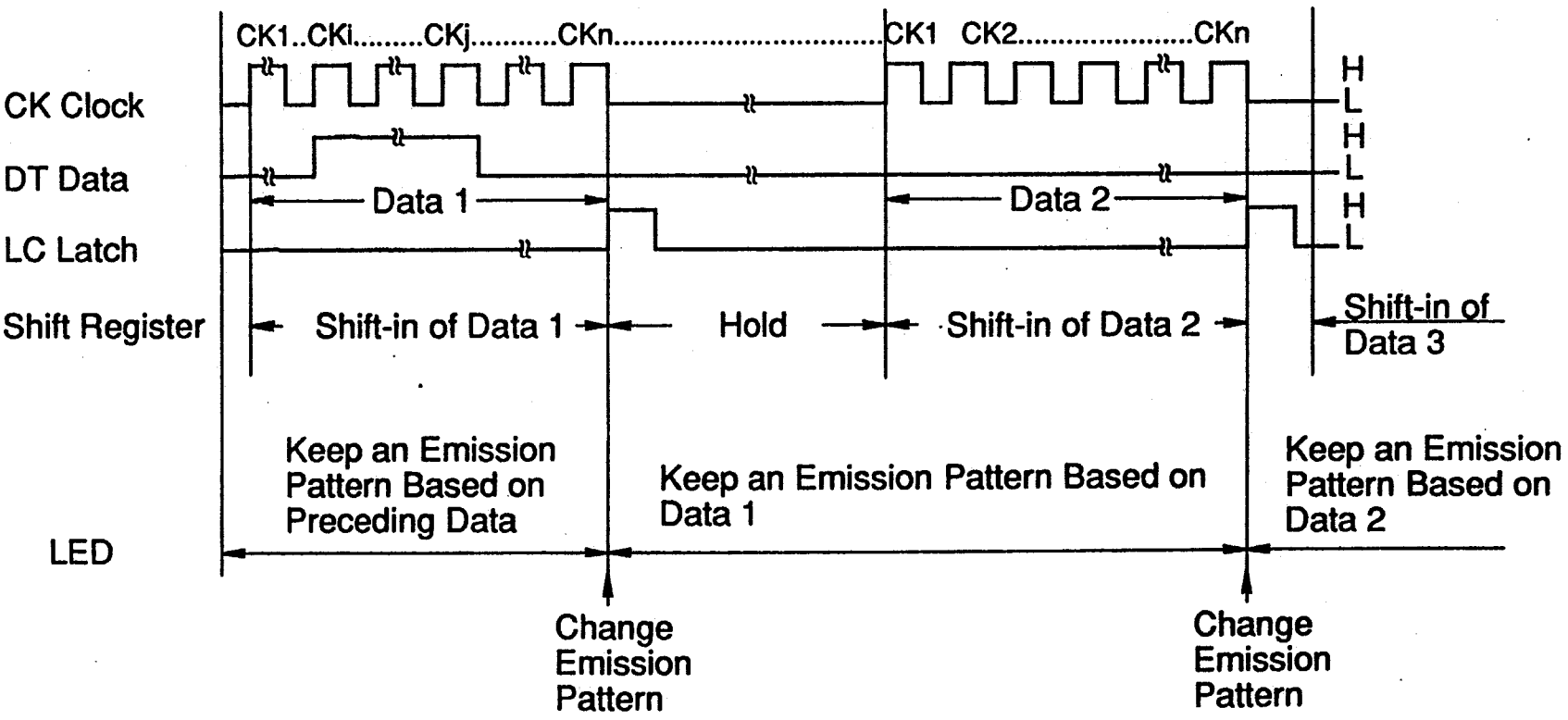
FIG. 4 is a basic timing chart of an LED driving system.

Next, an operation of the IC13 for driving will be described as follows in a timing chart in FIG. 4. As an example, the case in which LED Li to LED Lj, which are i-th LED to j-th LED in the LED array, are turned on, will be described as follows. In a period in which clock signals CKl - CKn, the number of which corresponds to number "n" of the LED, are successively inputted in the order of the LED, turning-on data input DT corresponding to LED Li-Lj in the portion in which the LED array is required to be turned on is made H level. Under these conditions, after n-th clock signal has been inputted, the driving pulse LC is inputted. Namely, the turning-on data is maintained at H level for a predetermined period of time. Then, the turning-on data in the portion (LED) which is required to be turned on is stored in the latch memory 22, thus the data of the turning-on portion can be prepared. Next, when the driving control circuit is turned on by strobe signal ST, a signal is outputted from output terminals DOi-DOj based on the turning-on data stored in the latch memory, and the LED array is turned on and maintained. In the case in which the LED array is turned off, when the turning-on data DT is made L level for the period of time in which n (number of LEDs) clock signals CKl-Ckn are inputted, all latch memories are made in the state in which the turning-on data is not stored, namely 0 (zero) is stored. Then, when driving pulse LC is made a predetermined time to a high level H, 0 data is stored in the latch memory 22. Next, the driving control circuit turns off all the LEDs at one time based on the data stored in the latch memory. The above-described operation is a basic operation of the IC for driving, which is the conventional driving method.

Figure 5:
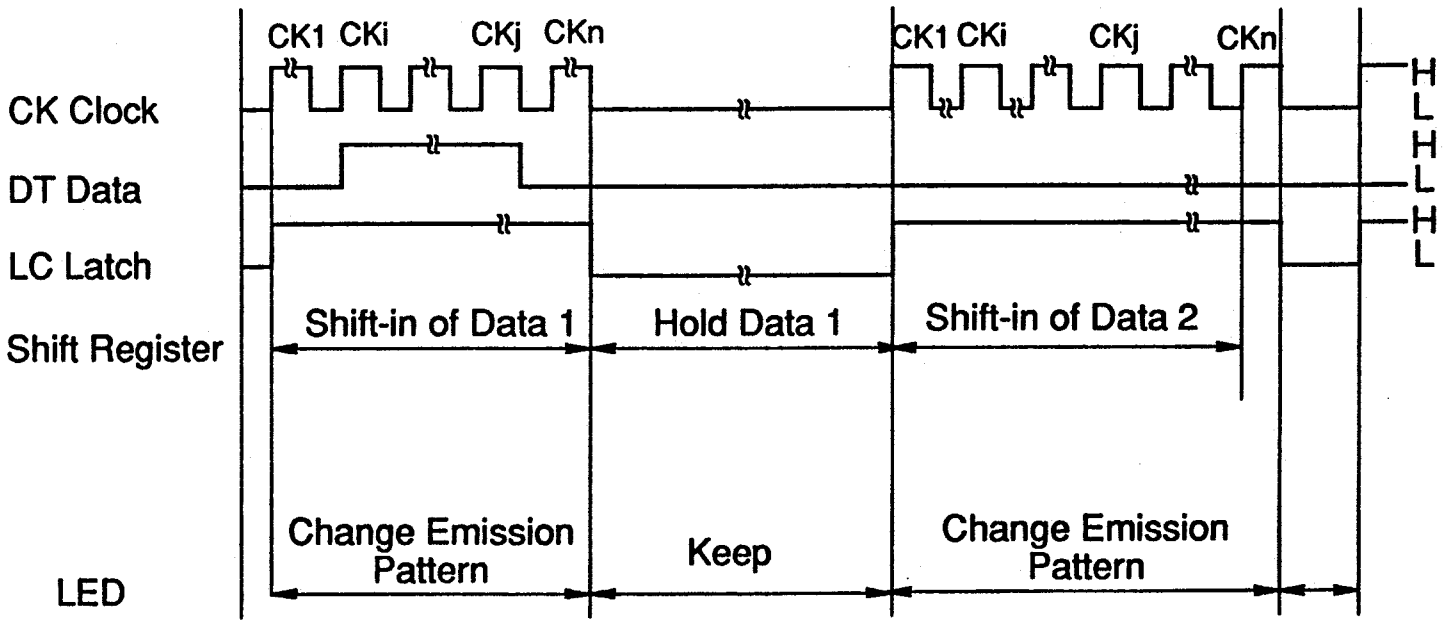
FIG. 5 is a timing chart of the driving system when the LEDs are turned on successively.
Figure 7A:
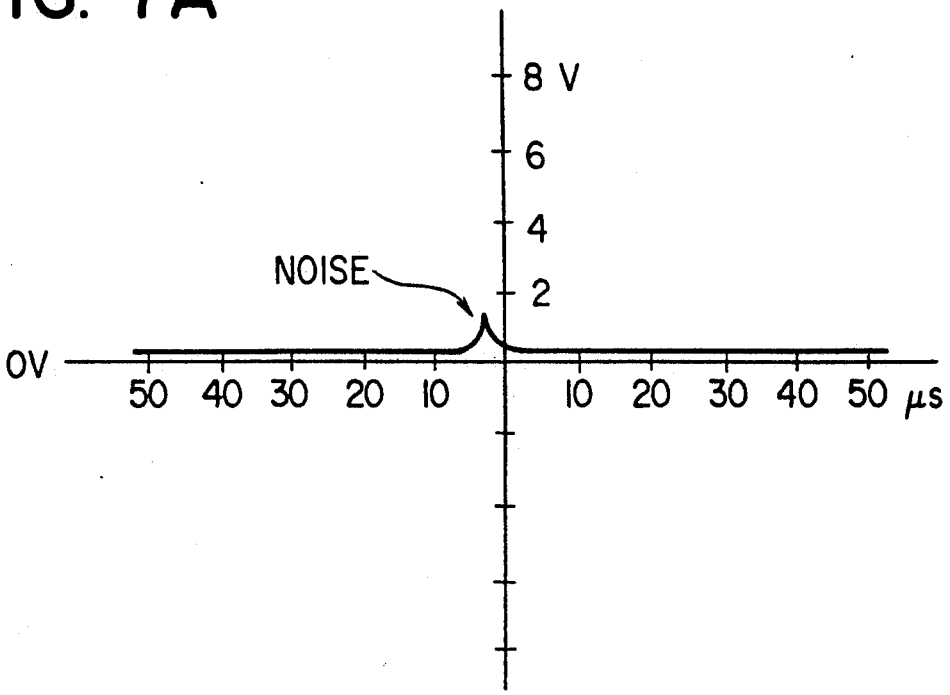
FIG. 7*a* and FIG. 7*b* are drawings showing a wave form of a spike noise.
Figure 7B:
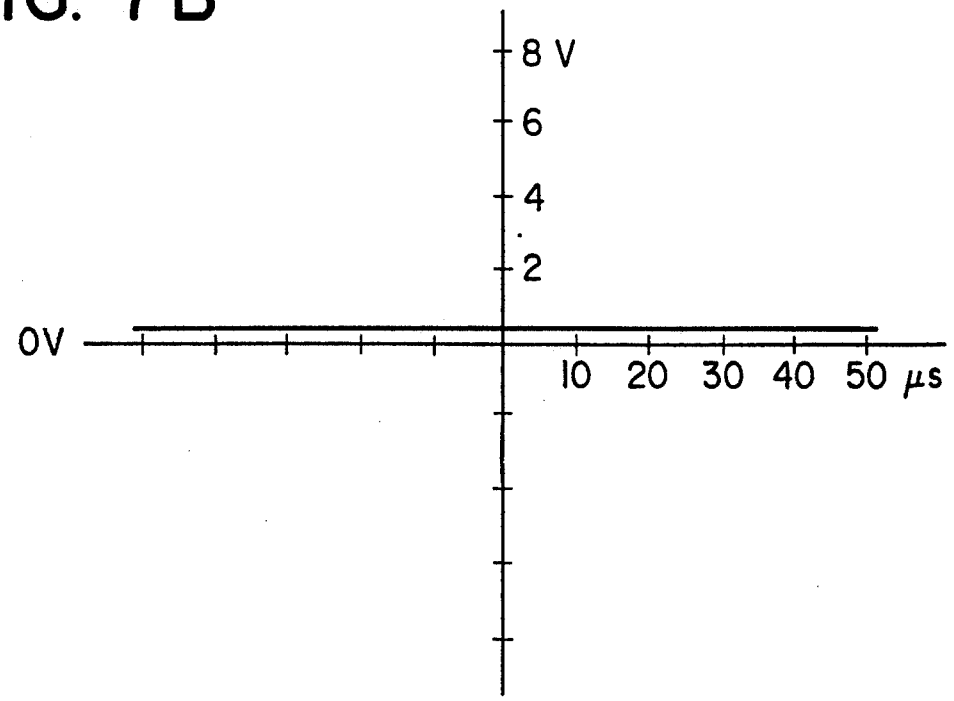
Figure 8:
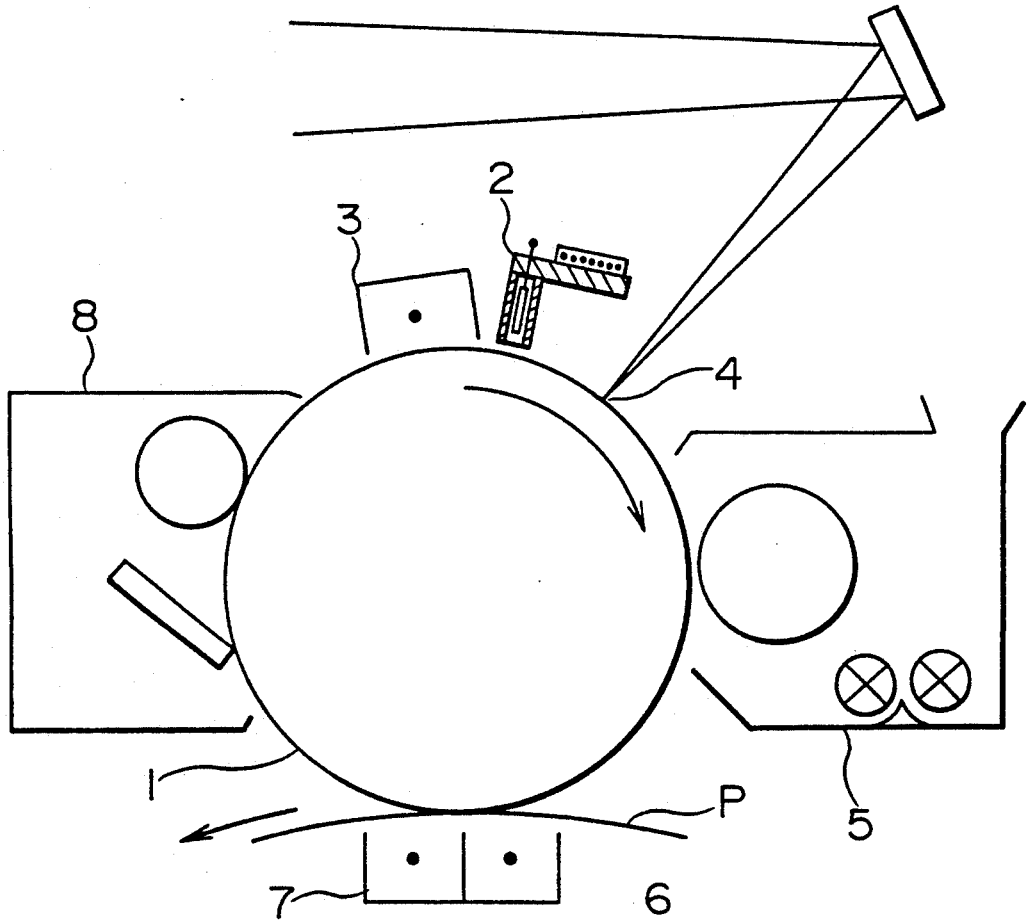
FIG. 8 is a drawing showing an overall structure of a copying apparatus.

However, as described above, the conventional driving method has problems in which spike noises are generated as shown in FIG. 7-A. In the present invention, the driving control circuit is made previously in the state of ON by the strobe signal. Then, as shown in FIG. 5, in a period in which clock signals CKl-CKn, the number of which corresponds to the number "n" of LEDs, are successively inputted in the order of the LEDs, turning-on data input DT is made high level continuously for the period, and at the same time, driving pulse LC is made continuously H level. Then, LED Li-Lj of the LED array is not turned on at one time, and the turning-on data is stored in the latch memory 22 one by one according to clock signals CKl-CKn which are successively inputted, and the LEDs are turned on in the order of LED Li, Li+1, . . . Lj successively. After the n-th clock signal has been inputted; when the driving pulse LC are made L (Low) level for a predetermined period of time, the turning-on of the LED array which is required to be turned, is maintained. The right portion of the timing chart shows, as an example, a case where all LEDs are instructed to change to a non-emission state. The input data DT is made L level with respect to all LEDs, and further, driving pulse LC is made H level for the period in which clock signals CKl-CKn are inputted. Then, the stored data of the latch memory 22 becomes 0 according to clock signals CKl-CKj which are inputted successively. In this case, LEDs repeat turn-off and turn-on successively and not simultaneously, there is no transient phenomenon of a rush current as shown in FIG. 7-B, and spike noises as shown in FIG. 7-A can not be generated.

Figure 6:
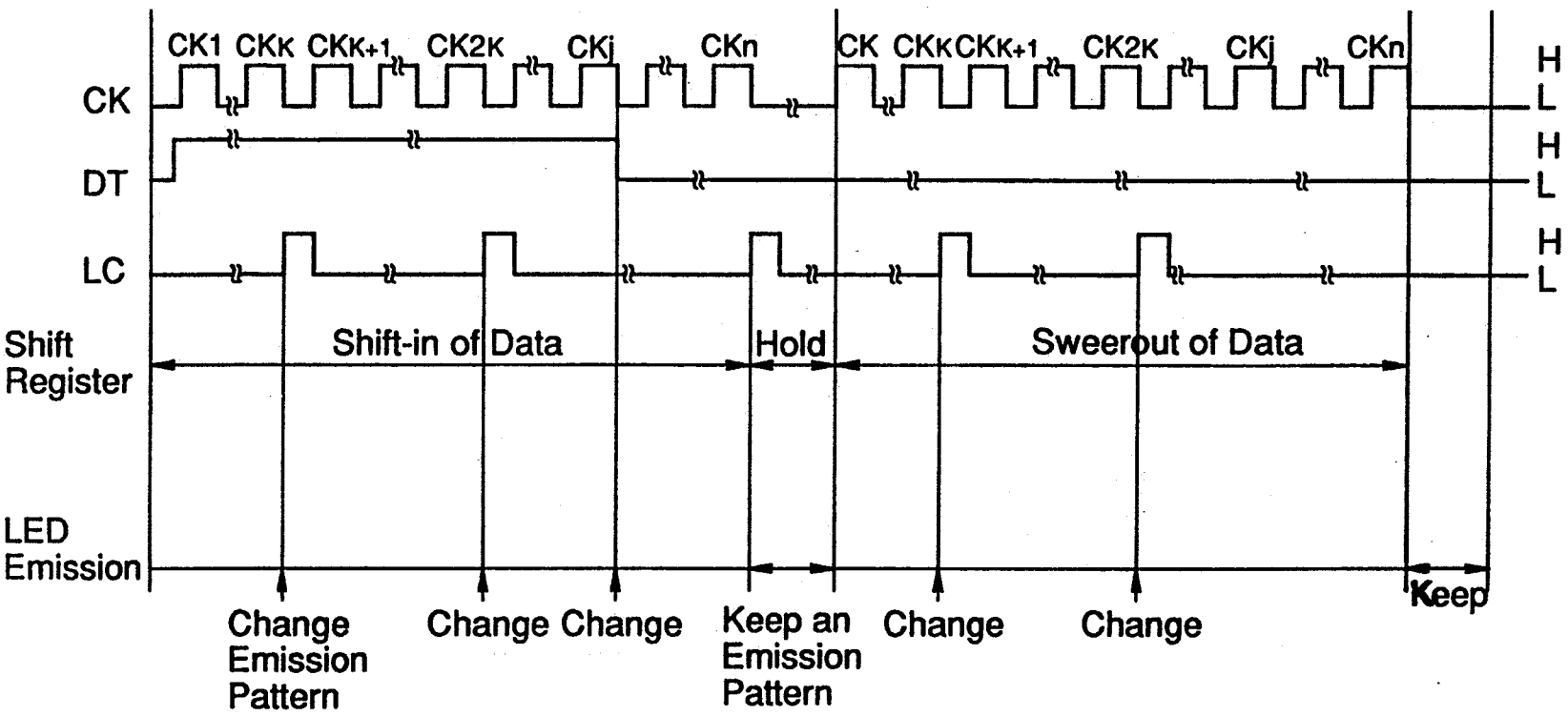
FIG. 6 is a timing chart of the driving system when LEDs are turned on by a block.

In order to eliminate the transient phenomenon of the current without generating noises, it may be possible that a plurality of LEDs are defined as one block and the blocks are turned on or turned off successively instead of changing LED state on one by one. As an example, referring to the timing chart in FIG. 6, the case where k LEDs are defined as one block in the LED array, and LED L1-Lj, which means from the first LED to the j-th LED, are turned on (or turned off), will be described as follows. In a period in which clock signals CKl- CKn are inputted, the period of CKl-CKj is marked, and turning-on data input DT of LED L1-Lj is made H level, in a similar way to that described above. Then, the turning-on data of LED L1-Lj, which is necessary for the turning-on, is made in the in which it can be stored in the latch memory 22. At the time when clock signals CKl, CK2, . CKk are inputted successively and k-th clock signal CKk is inputted, when only one pulse is made H level, the turning-on data for k LEDs is stored in the latch memory, and then LED L1-Lk are turned on at one time, so that their turned-on condition is maintained. Next, when only one pulse of the driving pulse LC is made H level at the time when clock signal CK2k is inputted, LED Lk-L2k are turned on, so that 2k LEDs, that is, LED L1-L2k are turned on and the turned-on condition is maintained. In the way described above, k LEDs are made one block and LEDs are turned on successively to j-th LED Lj. Then, the light emitting elements of Li to Lj keep emission for a predetermined time period. When all LEDs are turned off after the above state, the input data DT is made L level and 0 is made possible to be stored in the latch memory 22 in the same way as described above. Then, the driving pulse LC is made H level at each k-th clock signal, so that each block can be turned off successively. In any case, driving the turning-on/turning-off is controlled by strobe signal ST finally.

As described above, an overall control such as: recording the turning-on data by which the LED array is turned on in accordance with a document size; transference of the driving pulse; and turning-on of a necessary portion and discharging of an unnecessary portion in synchronization with the clock signal or a rotation timing of the photoreceptor drum, is performed by the control CPU provided in the main body of the copying apparatus.

Conventionally, when an LED array of a discharging apparatus which is used for discharging, has been turned on or turned off (driving of an LED array), all LEDs to be turned on or turned off have been turned on or turned off at one time. Therefore, there have been problems in which noises have been generated and malfunction has been caused by a transient phenomenon of a current. However, those problems are solved by the present invention which can provide a discharging device for a copying apparatus by which noises are not generated, a life of an LED can become long, a malfunction can be prevented, toner density is always stable, and a high quality image can be obtained.

What is claimed is:

1. A neutralizer for use in an image forming apparatus for eliminating, by a light beam emission, an electric charge from a non-image area of a surface of an image carrying member, said neutralizer comprising:

light emitting means, having a plurality of light emitting elements arrayed facing the surface of the image carrying member and in an order along a line across a width of the image carrying member, for emitting a light beam from each light emitting element and being adapted to eliminate an electric charge on a selectively predetermined portion of the surface along the line by selectively emitting a light beam form each of the light emitting elements;

a shift register for storing a binary data, said shift register having a plurality of register cells corresponding one-to-one to the light emitting elements, wherein a bit of the binary data stored in each said register cell instructs a selective light beam emission from its corresponding light emitting element, and wherein the shift register shifts the binary data bit by bit through said register cells in synchronization with a clock pulse during a first time period and holds the binary data during a second time period, said first and second time periods each comprising a plurality of clock pulse periods; and driving means for making each light emitting element selectively emit the light beam based on a binary data in the shift register during both the first time period and the second time period.

2. The neutralizer of claim 1, wherein the driving means comprises:

means for latching the binary data by repeatedly storing the binary data from the shift register with a time interval of a predetermined number of clock pulses; and driver circuit means for driving the light emitting means so that each light emitting element selectively emits a light beam based on the latched binary data in the latching means.

3. The neutralizer of claim 1, wherein:

each register cell of the shift register corresponds to a pair of light emitting elements; and the driving means drives each pair of light emitting elements based on a bit stored in the register cell which corresponds to each pair of light emitting elements.

* * * * *